US012336610B2

(12) United States Patent
Ganem et al.

(10) Patent No.: US 12,336,610 B2
(45) Date of Patent: Jun. 24, 2025

(54) HAIR TREATMENT DEVICE WITH IMPROVED SEALING AND EFFICIENCY

(71) Applicant: SEB S.A., Ecully (FR)

(72) Inventors: Mathias Ganem, Lyons (FR); Johan Sabattier, Tassin la Demi Lune (FR)

(73) Assignee: SEB S.A. (FR)

( * ) Notice: Subject to any disclaimer, the term of this patent is extended or adjusted under 35 U.S.C. 154(b) by 603 days.

(21) Appl. No.: 17/620,385

(22) PCT Filed: Jun. 18, 2020

(86) PCT No.: PCT/EP2020/067030
§ 371 (c)(1),
(2) Date: Dec. 17, 2021

(87) PCT Pub. No.: WO2020/254531
PCT Pub. Date: Dec. 24, 2020

(65) Prior Publication Data

US 2022/0240640 A1 Aug. 4, 2022

(30) Foreign Application Priority Data

Jun. 21, 2019 (FR) ..... 1906741

(51) Int. Cl.
*A45D 1/04* (2006.01)
*A45D 1/00* (2006.01)
*A45D 2/00* (2006.01)

(52) U.S. Cl.
CPC ..... *A45D 1/04* (2013.01); *A45D 2/001* (2013.01); *A45D 2001/008* (2013.01)

(58) Field of Classification Search
CPC ... A45D 1/00; A45D 1/04; A45D 1/06; A45D 1/08; A45D 1/18; A45D 1/28;
(Continued)

(56) References Cited

U.S. PATENT DOCUMENTS

2006/0201924 A1* 9/2006 Hirata ..... A45D 1/04 219/225
2015/0327650 A1* 11/2015 Fereyre ..... A45D 1/06 132/269

(Continued)

FOREIGN PATENT DOCUMENTS

FR 3011449 A1 4/2015
GB 2567450 A 4/2019

(Continued)

OTHER PUBLICATIONS

International Search Report for PCT/EP2020/067030 dated Sep. 10, 2020. 2 pgs.

*Primary Examiner* — Rachel R Steitz
*Assistant Examiner* — Karim Asqiriba
(74) *Attorney, Agent, or Firm* — Lerner David LLP

(57) ABSTRACT

A hair treatment device includes a first and a second arm, movable in relation to each other, which can be opened to introduce a strand of hair between them and closed to treat the strand of hair, a first and second contact surfaces respectively supported by the first and second arms, arranged facing each other, with at least one of the contact surfaces being heated, at least the first arm having at least one first piece supporting the first contact surface, a sealing element including a central window arranged such that it extends at least partially around the first contact surface between the latter and the first supporting piece, wherein the sealing element includes at least one opening that is distinct from the central window and the first supporting piece and the first contact surface come into contact with each other through the at least one opening.

13 Claims, 8 Drawing Sheets

(58) Field of Classification Search
CPC .. A45D 2001/008; A45D 2/001; A45D 2/002; A45D 20/48; A45D 20/50; A45D 19/16
See application file for complete search history.

(56) References Cited

U.S. PATENT DOCUMENTS

| | | | | |
|---|---|---|---|---|
| 2020/0397110 | A1* | 12/2020 | Fereyre | A45D 1/00 |
| 2022/0071364 | A1* | 3/2022 | Ganem | A45D 1/08 |

FOREIGN PATENT DOCUMENTS

| | | | | |
|---|---|---|---|---|
| WO | 2015000217 | A1 | 1/2015 | |
| WO | WO-2019073199 | A1 * | 4/2019 | A45D 1/04 |
| WO | 2019122401 | A1 | 6/2019 | |

* cited by examiner

[Fig 1]
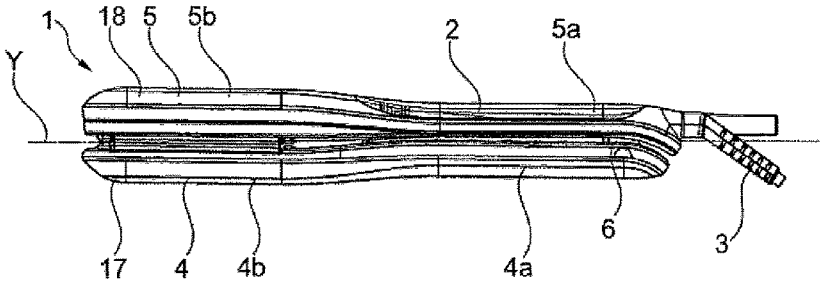
[Fig 2]
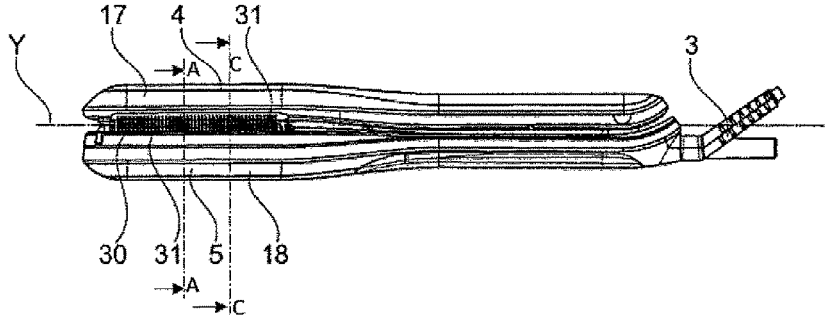
[Fig 3]
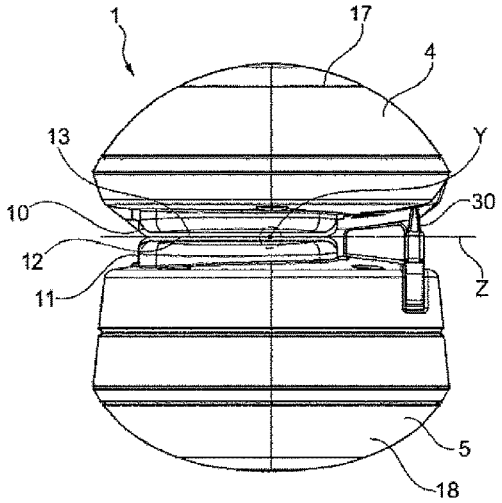

[Fig 4]
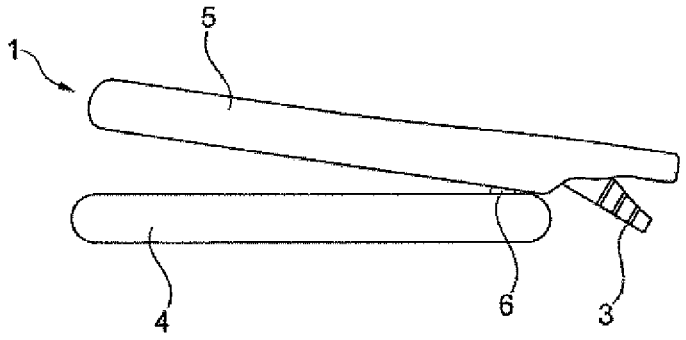
[Fig 5]
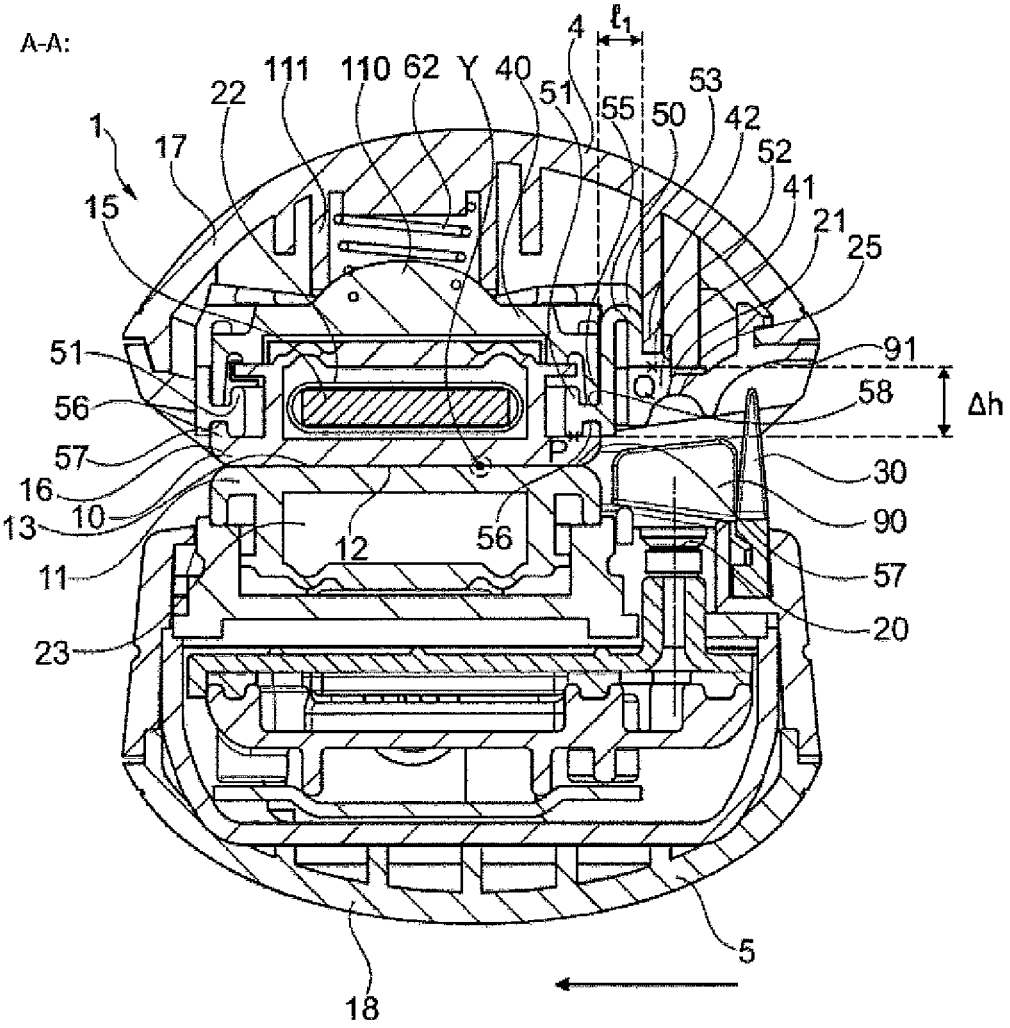

[Fig 6]
A-A:
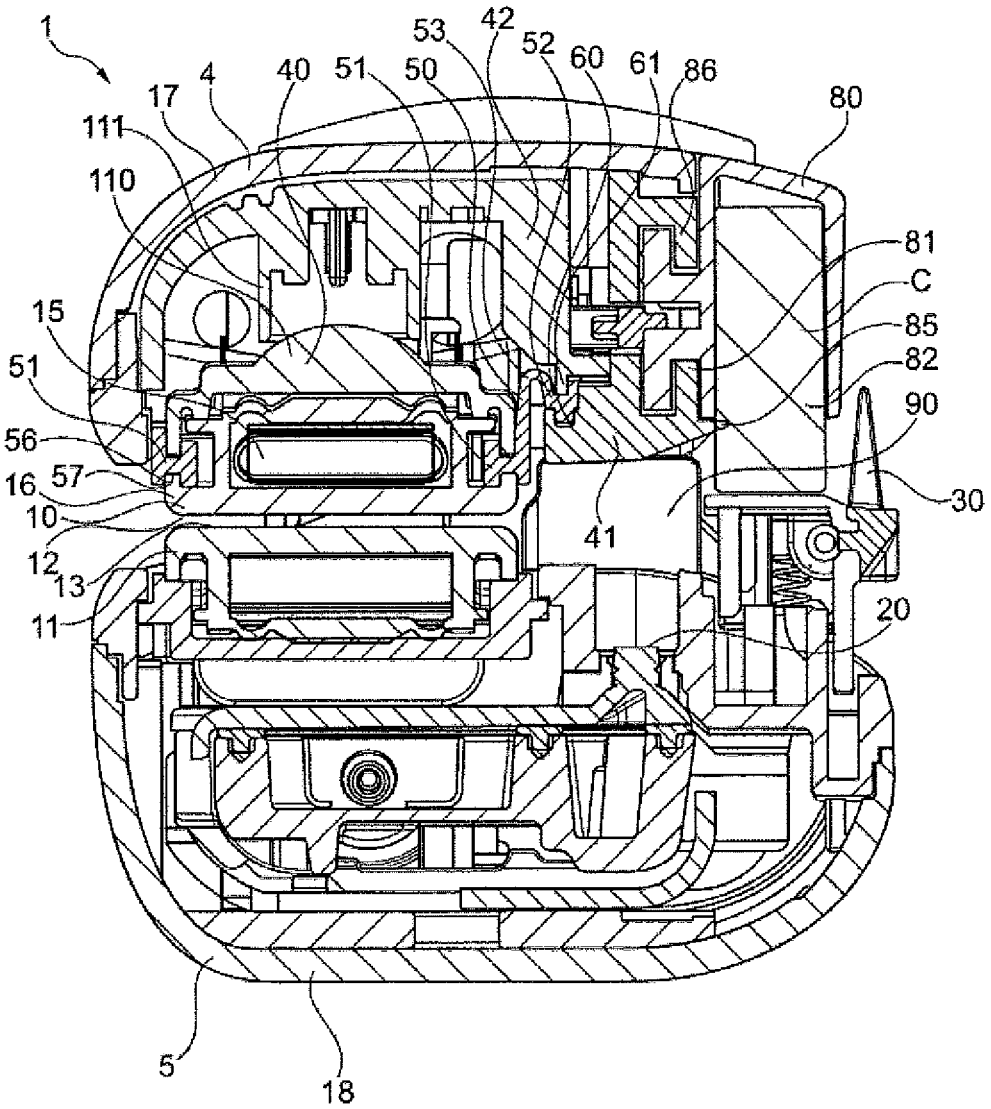

[Fig 7]
A-A:
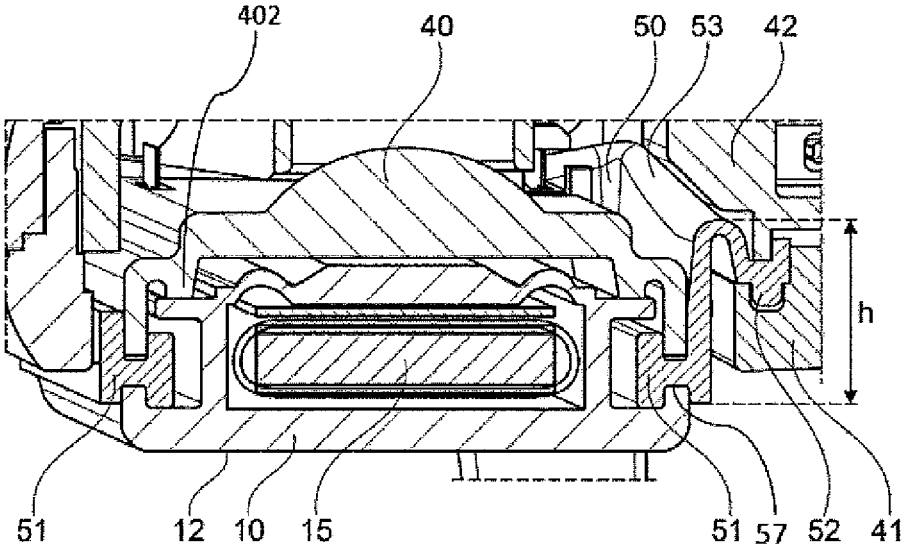
[Fig 8]
C-C:
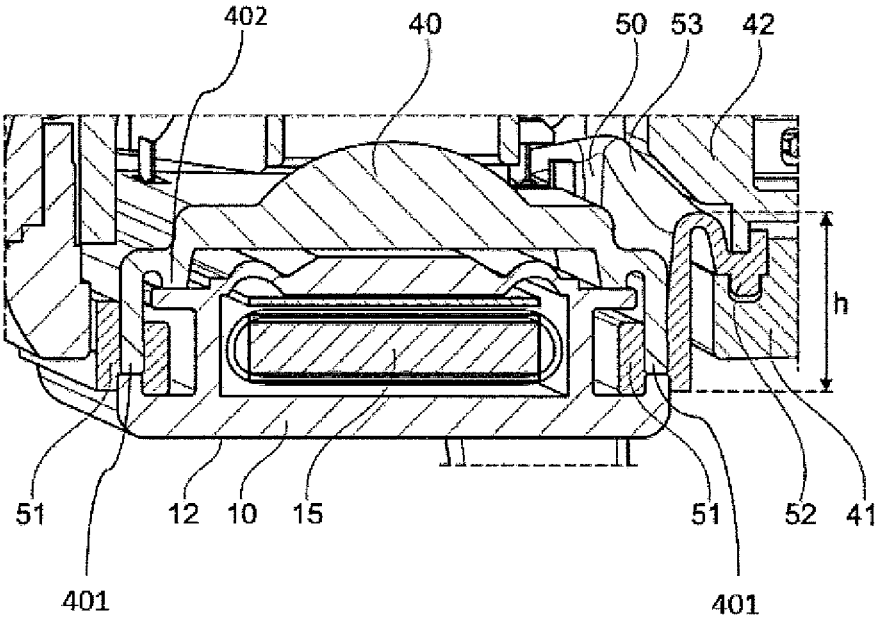

[Fig 9]
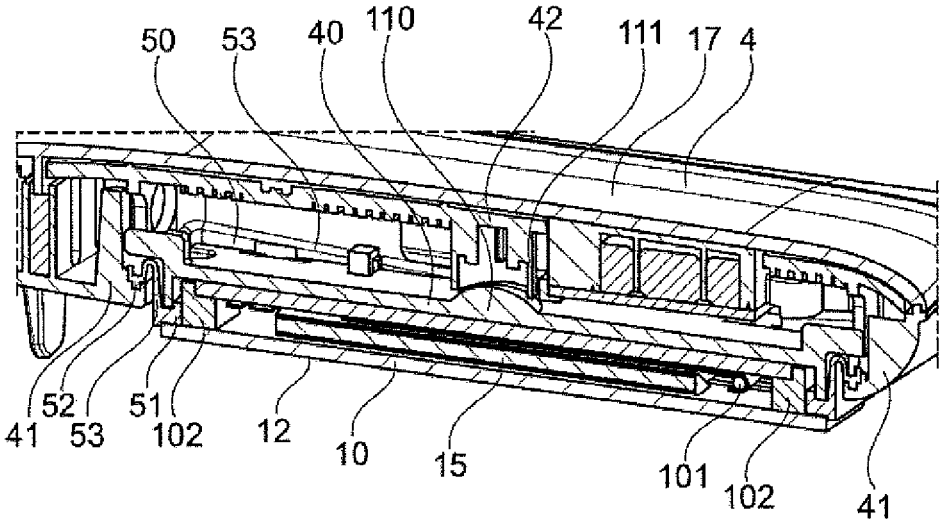

[Fig 10]
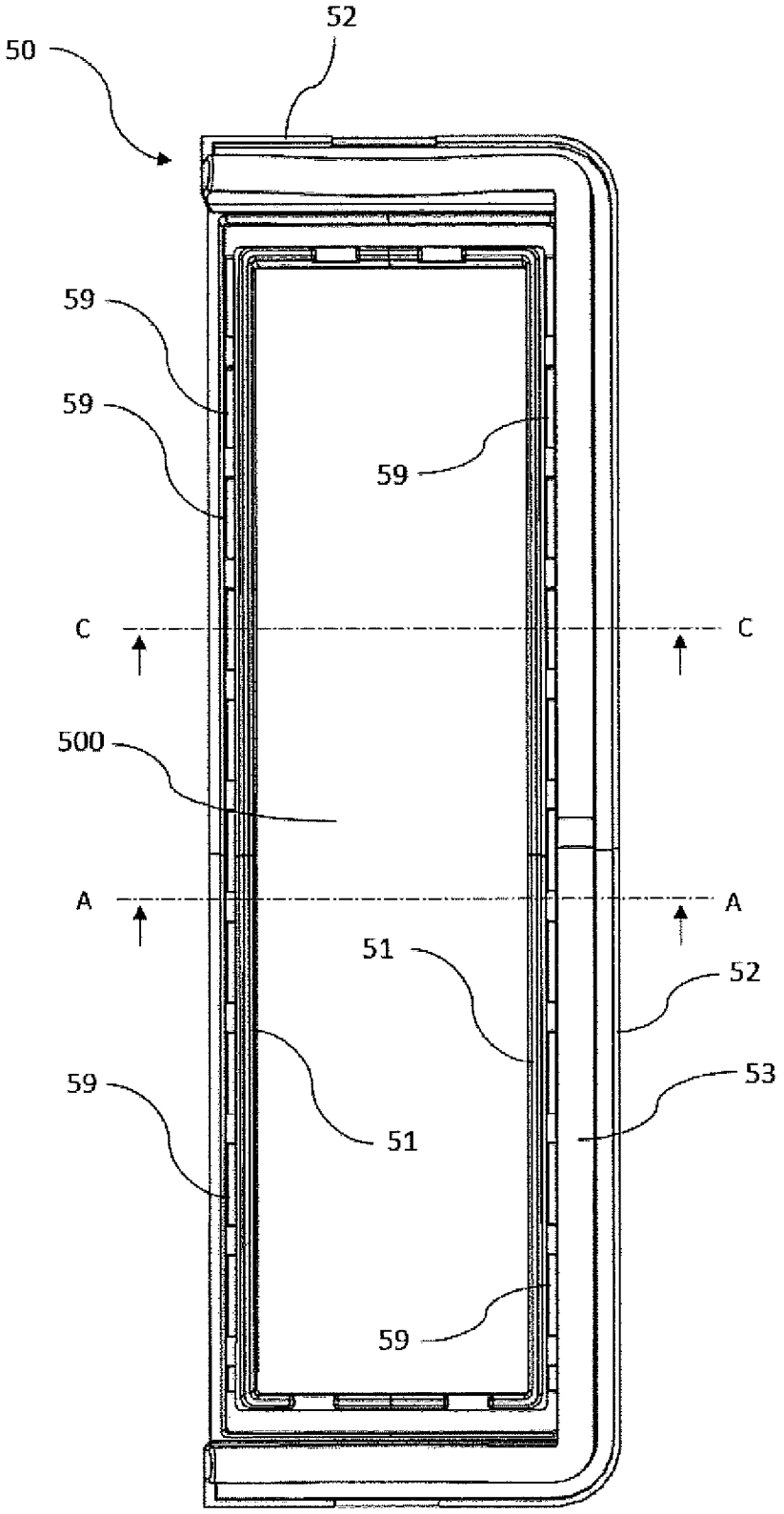

[Fig 11]
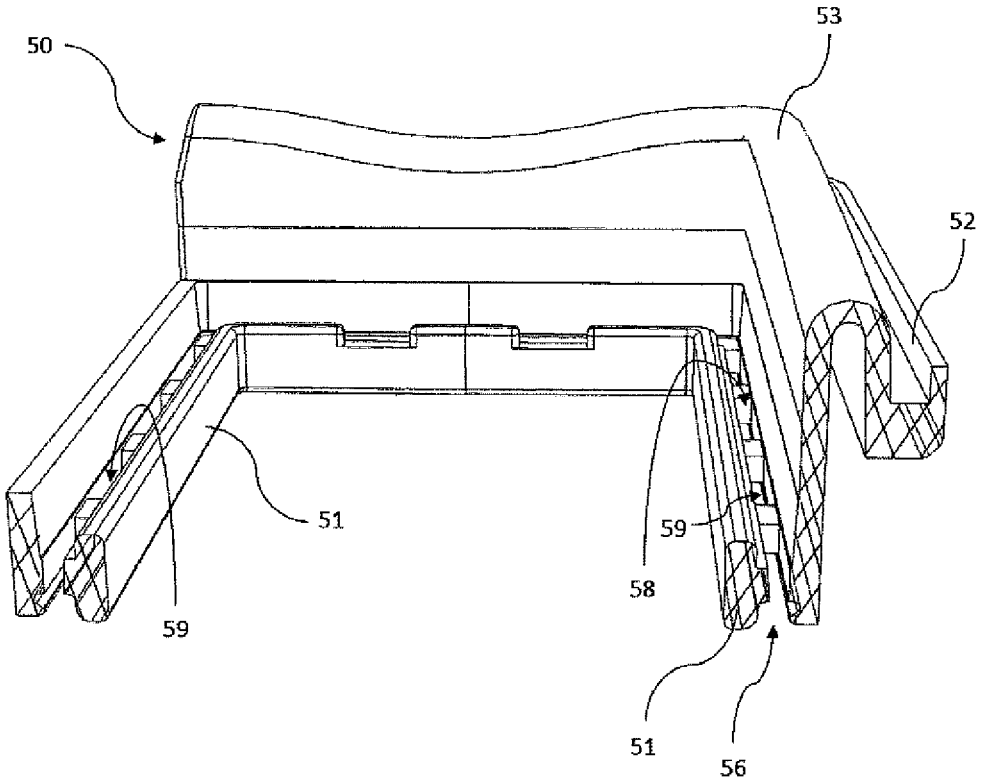

[Fig 12]
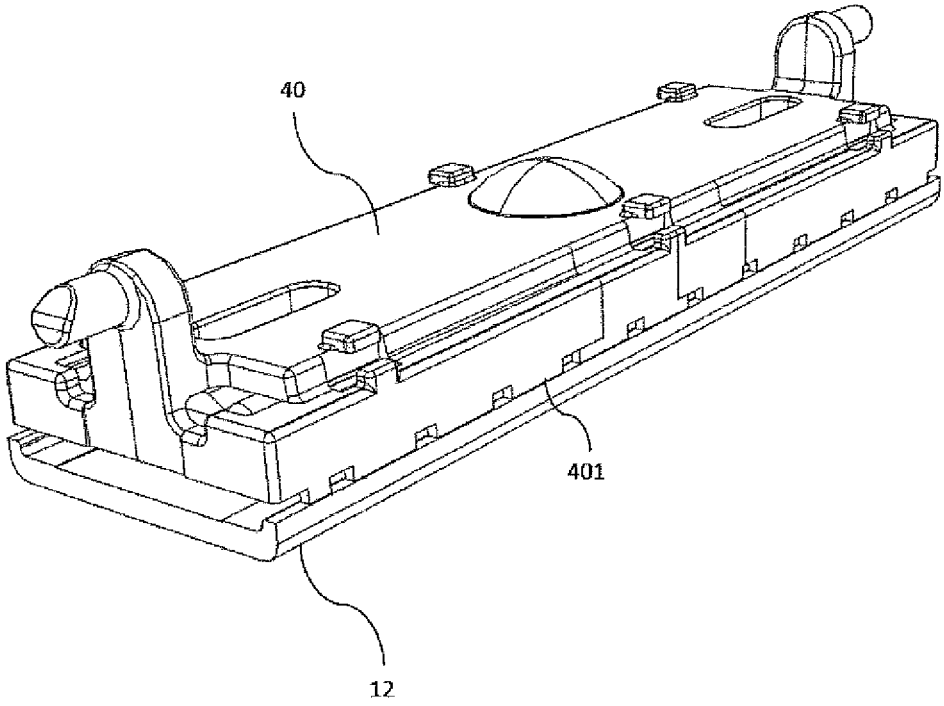

HAIR TREATMENT DEVICE WITH IMPROVED SEALING AND EFFICIENCY

CROSS-REFERENCE TO RELATED APPLICATIONS

The present application is a national phase entry under 35 U.S.C. § 371 of International Application No. PCT/EP2020/067030 filed Jun. 18, 2020, which claims priority from French Application No. 1906741 filed Jun. 21, 2019, all of which are incorporated herein by reference.

TECHNICAL FIELD

This invention relates to a hair treatment device and more particularly to a tong-type hair straightener.

PRIOR ART

It is a common practice to straighten hair with straightening tongs, such a device also being called a straightener. These tongs, which are typically equipped with two heating plates arranged facing each other so as to clamp the hair, make it possible to smooth the capillary fibers without pulling too hard on the hair, contrary to blow-drying. However, in order to obtain a neat, smooth appearance, multiple passes must be made with the tongs, which considerably lengthens the treatment time. Moreover, the repeated application of the straightener can sometimes damage the capillary fibers, due to the temperature to which the hair is exposed.

To limit the number of passes, steam and/or a cosmetic product is commonly used to treat the hair, in combination with a treatment using heating plates. Such a method can be implemented using a hair treatment device.

To ensure the safe operation of these straightener-type devices, in particular if they are used with steam and/or cosmetic products on the hair, it has been proposed to fit a seal around the heating plates so as to prevent the steam, the cosmetic product or any other element from penetrating into the device, as is the case, for example, in the international patent application filed by the applicant under number PCT/EP2018/086741.

This solution, though entirely satisfactory in terms of the safe use of the device, can eventually have certain drawbacks, in particular with regard to the performance and efficiency of the hair straightening. Indeed, it was found that the seal, which is intrinsically flexible, is deformed when the plates clamp onto the strand of hair and therefore it absorbs piece of the clamping pressure. This can result in a hair styling device that is less efficient, which can be disappointing, or require additional passes to obtain an optimal styling result if the seal deformation is not compensated by the application of greater pressure by the user.

There is thus a need to improve the existing devices.

PRESENTATION OF THE INVENTION

The present invention aims to remedy the aforementioned drawbacks.

One of the purposes of the invention is to propose a hair treatment device that is particularly efficient, in particular by limiting the number of passes on the hair.

Another purpose of the invention is to propose a hair treatment device that is particularly safe, reliable and robust.

Another purpose of the invention is to propose a hair treatment device that is particularly ergonomic and comfortable to use.

Another purpose of the invention is to propose a hair treatment device that is inexpensive and easy to manufacture.

These purposes are achieved using a hair treatment device comprising:

- a first and a second arm, movable in relation to each other, which can be opened to introduce a strand of hair between them and closed to treat the strand of hair, a first and second contact surfaces respectively supported by the first and second arms, arranged facing each other, with at least one of said contact surfaces being heated,
- at least the first arm comprising at least one first piece supporting the first contact surface,
- a sealing element comprising a central window arranged such that it extends at least partially around the first contact surface between the latter and the first supporting piece, said sealing element comprising at least one opening that is distinct from the central window and said first supporting piece and said first contact surface coming into contact with each other through said at least one opening.

It should be noted that the term "hair" may include the corresponding human or animal keratin fibers, as well as synthetic fibers, known as "extensions" that are sometimes attached to a person's natural hair by various means, in particular by bonding, in order, for example, to change the appearance of a person's natural hair.

"Central window" refers to a main opening arranged substantially in the center of the sealing element. This central window makes it possible to house the first supporting piece and the first contact surface and therefore allows the sealing element to surround these elements at least partially, and advantageously completely.

Preferentially, the sealing element comprises a plurality of openings. Advantageously, said plurality of openings is evenly spaced around the central window.

The invention thus makes it possible to obtain a device in which the pressure exerted by the user on the first and second arms is fully transmitted to the contact surfaces. The direct contact between the first piece and the first contact surface through said at least one opening, and preferentially through the plurality of openings, guarantees integral transmission of the mechanical forces. There is thus no wasted effort and the user is not required to exert force on the device to obtain a good hairstyling result. Moreover, if the openings are evenly spaced around the central window, this ensures that the forces are evenly distributed. Even though the sealing element comprises a plurality of openings, its presence nevertheless guarantees the sealing of the device against outside elements and therefore makes the device more reliable, more robust, and safer to use.

Advantageously, said sealing element comprises between 10 and 30 openings, preferentially between 18 and 24, for example 20 or 22 openings.

Preferentially, said plurality of openings is evenly spaced around the first contact surface, advantageously symmetrically.

Preferentially, the device comprises at least one steam outlet supported by one of the arms at a distance from the contact surface on the same arm, so as to expose the hair held between the arms to the steam. More precisely, the steam outlet is positioned at a distance from the contact surface as this makes it possible to clearly distinguish between treating the hair with steam and then with mechanical force using the device's contact surface. This ensures better styling results, in particular by allowing the steam to open the scales on the hair before running it through the heated contact surface. "At a distance" implies, in particular, that the steam outlet is separate from the contact surface, that it is not positioned inside the contact surface.

This invention therefore provides a device that limits the amount of steam that can penetrate into an interior space of the arms due to the presence of the sealing element, while ensuring the full transmission of the mechanical forces between the various pieces. In other words, the casing (namely, the shell of each arm) that forms the walls of the arms is sealed off from the steam projected by the device, while the transmission of the mechanical forces from the casing actuated by the user to the smoothing plate (namely the first contact surface) is also ensured.

Preferably, at least the first contact surface, and preferably each of the contact surfaces, is pivotally mounted on the corresponding arm, for example by means of a ball joint or the like.

Preferentially, the device comprises at least one second piece that is distinct from the first piece and separate from the latter, the elastically deformable sealing element comprising a proximal portion extending at least partially around the first contact surface between the latter and the first supporting piece and a distal portion extending in contact with the second piece, the proximal portion and distal portion being connected by an intermediate portion extending between the first piece and the second piece and designed to form a barrier to the steam.

The presence of the intermediate portion on the sealing element allows the latter to deform to accompany the pivoting of the contact surface, such that the movement of the latter is not unduly hampered by the presence of the sealing element. The contact surface can then pivot to best accommodate the thickness of the strand of hair in contact with it, and the efficiency of the heat treatment is improved, while maintaining a perfect seal due to the presence of the three areas of the seal (proximal portion, distal portion, and intermediate portion, which can become deformed).

The overall length of the intermediate portion, measured in the cross section, may be greater than 6 mm, particularly 7.5 mm, in particular comprised between 7 mm and 13 mm, particularly between 7.5 mm and 12 mm.

The intermediate portion connects the proximal and distal portions such that different heights and/or widths can be obtained, if desired, in other words, along a horizontal and/or vertical plane, between the proximal portion and the distal portion, preferably greater than 2 mm and advantageously substantially equal to 3.5 mm. The proximal portion advantageously extends over the entire periphery of the first contact surface. A seal is therefore created around the entire periphery of this contact surface, thus preventing water or any other element from penetrating into the device. In addition, this makes it possible to strengthen the mechanical fixation of the sealing element.

Said intermediate portion advantageously has at least one cross-sectional bend. In this case, the intermediate portion is, for example, concave, curving towards the opposite arm, preferably the arm bearing said at least one steam outlet, in particular with a U-shaped bottom in the cross section. The intermediate portion may comprise several bends, similar to a bellows, such as, for example, an accordion bellows.

The width of the intermediate portion of the seal, measured in a plane that is perpendicular to a longitudinal axis of the device, is preferably greater than or equal to 1 mm.

The presence and shape of the sealing element, with the proximal, intermediate, and distal portions, makes it possible to create an effective barrier against the steam so that it does not penetrate inside the device, along the first contact surface. In addition, the intermediate portion has a flexibility that allows it to accept a greater tolerance in the positioning of the first and second pieces relative to each other. This variation in positioning between the first and second pieces may indeed be unintentional as a result, for example, of manufacturing variations or on the contrary and advantageously, it may be intentional, resulting from a controlled mobility of the first contact surface. According to this advantageous embodiment, the first piece is preferentially connected to the casing of the device by a ball joint, such that the smoothing contact surface can have varying degrees of leeway so that the latter can best adapt to the thickness and positioning of the strand of hair. Such an assembly is known to the person skilled in the art or, for example, from document FR3011449, and is therefore not further detailed herein.

Advantageously, said at least one opening is made in the proximal portion. This makes it possible to simplify the construction of the device and in particular the sealing element. Moreover, it makes it possible to arrange the opening or openings of the first contact surface, and thus the contact points between the latter and the first piece, more closely together, which helps optimize the distribution of the forces on the first contact surface.

Preferentially, said sealing element is clamped between the first contact surface and a ridge of the first piece, in particular having a cross section that is generally H-shaped, with a groove inserted into a return of the first contact surface and an opposite groove inserted into said ridge of the first piece. In particular, it is the proximal portion that can be clamped according to the previous assembly. This makes it possible to keep the proximal portion of the sealing element sealed in place around the contact surface, and therefore more generally to ensure that the sealing element remains correctly positioned around the contact surface.

Advantageously, said at least one opening is made between the grooves so that said grooves communicate with each other. This allows for a simple construction that ensures proper transmission of the mechanical forces.

Preferentially, the distal portion of the sealing element can be clamped between the second piece and a third internal piece of the first arm. This makes it possible to keep the sealing element sealed in place, away from the first contact surface. In this case, the second piece can have a groove in which the distal portion is at least partially received, with the third piece having a ridge resting on the distal portion directly above said groove.

Preferentially, the sealing element is substantially rectangular in shape with two sides forming the length of the rectangle and two sides forming the width of the rectangle, said plurality of openings being arranged solely on the two sides forming the length of said rectangle. This makes it possible to limit the number of openings to be made inside said sealing element and thus limit the latter's manufacturing cost, but also makes it easier to assemble the sealing element to the other pieces. The absence of any opening on the two sides forming the width of the rectangle makes it possible to easily adjust the position of the sealing element when assembling it and optionally to slightly deform it if necessary. Said plurality of openings is then advantageously symmetrically spaced on both sides forming the length of the rectangle, relative to an axis running parallel to said sides through the center of the first contact surface. For example, the sealing element can comprise 10 or 11 openings on each of the sides forming the length of the rectangle.

Preferentially, said first piece comprises, on at least piece of its periphery, at least one slot in contact with the first contact surface through said at least one opening. Of course, in the preferential case in which the sealing element comprises a plurality of openings, the first piece thus comprises, along at least its periphery, a plurality of slots in contact with the first contact surface through said plurality of openings. These slots make it notably possible to guarantee several points of contact between the first piece and the first contact surface, which makes it possible to guarantee and to optimize the transmission of the mechanical forces, while at the same time guaranteeing the sealing around the first contact surface. Moreover, the maintenance of the sealing element around the first contact surface is optimized.

Advantageously, said first piece comprises between 10 and 30 slots, preferentially between 18 and 24, for example 20 or 22 slots. In other words, the plurality of slots is identical to the plurality of openings; this means that the number of slots of the first piece corresponds exactly to the number of openings of the sealing element.

Advantageously, said plurality of slots is evenly spaced around the first piece, advantageously symmetrically.

Advantageously, said first piece comprises a plurality of slots in contact with the first contact surface through said plurality of openings on at least piece of the periphery of the contact surface. This allows the mechanical closing forces of the device to be transmitted through the periphery of the contact surface, which guarantees the even distribution of these forces and therefore good distribution of the pressure on the hair, while freeing up space inside the contact surface, for example to house other elements, as will be detailed below.

Advantageously, said first contact surface is substantially rectangular in shape with two sides forming the length of the rectangle and two sides forming the width of the rectangle, said plurality of slots being in contact with the first contact surface solely on the two sides forming the length of said rectangle. This makes it easier to assemble the sealing element, as explained above.

In this case, the intermediate portion and the distal portion can extend around three of the four sides of the first contact surface only. This limits the volume of the sealing element and, accordingly, the width of the device while forming a steam barrier. In this case, the intermediate portion and the distal portion are advantageously absent from the side of the first contact surface furthest from said at least one steam outlet. In other words, the sealing element then comprises a bellows on only three of these four sides, thus offering a notable compromise between sealing, flexibility, and volume.

In the preferential case above in which the first piece comprises one or more slots, the first piece also comprises a support ridge in contact with the first contact surface. This makes it possible to create an additional contact zone between the first piece and the first contact surface so as to be able to transmit more mechanical force. In the alternative, said at least one slot or the plurality of slots is the only contact with the first contact surface, which then means that the first piece does not have the aforementioned support ridge. This alternative construction thus has the advantage of limiting the risk of the assembly being statically indeterminate while freeing up space inside the first contact surface, for example to house other elements.

The intermediate portion can have a height which varies along one side at least of the first contact surface, and, better, along each side of the first contact surface. In this case, the height of the intermediate portion is preferably minimal, substantially at mid-length of at least one side of the first contact surface, and increases towards the ends of said side to be at its maximum at the angles. This difference in height is advantageously foreseen in order to enable the contact surface to move in case it pivots, the amplitude of these movements increasing with the distance from the rotational center. The overall length of the intermediate portion, measured in the cross section, is thus maximal at the angles, being at this location, for example, comprised between approximately 10 and 13 mm, preferably being equal to 11.7 mm. The overall length of the intermediate portion, measured in the cross section, is minimal in the middle of the sides, being at this location, for example, comprised between approximately 6 mm and 10 mm, preferably being equal to 7.9 mm.

In one embodiment, the sealing element has an asymmetrical shape relative to a median plane running through the first contact surface parallel to a longitudinal axis of the device and perpendicular to a heating surface of the first contact surface facing the second contact surface. This lack of symmetry is related to the lack of an intermediate portion and a distal portion on one of the sides of the first contact surface and makes it possible to reduce, as explained above, the width of the device however without damaging the sealing.

The sealing element is preferably present on a single arm, said at least one steam outlet then being supported by the other arm. Advantageously, the concave curved portion of the sealing element is slightly offset from the steam outlet, for example, being offset by 7 mm.

The device can comprise a cartridge containing a cosmetic composition. In this case, the second piece can serve as a support for said cartridge, in particular having a slide into which the cartridge is inserted.

Still in this case, the cartridge can comprise a porous material impregnated with said composition, in particular a felt, and the second piece can comprise a ridge pressing against said porous material, on the side opposite the sealing element, the ridge penetrating preferably partially into said porous material. Thus, the second piece with its ridge forms a seal with the porous material with respect to the steam emitted by said at least one steam outlet, which moreover does not generate any additional cost.

As a variant, the device may not comprise a cartridge for a cosmetic composition, nor an applicator for a cosmetic composition.

The second piece advantageously faces said at least one steam outlet.

The device can also comprise at least one comb comprising at least one row of teeth, the comb preferably being supported by the second arm.

The device advantageously comprises a confined area around said at least one steam outlet. "Confined area" means at least one piece or assembly of pieces that enables at least partial confinement of the steam generated by said at least one steam outlet. This confined area can be delimited by at least one of the following elements: a cartridge of cosmetic composition to be applied to the strand of hair, a comb, a confinement structure arranged substantially facing said at least one steam outlet, such confinement structure comprising, for example, at least one groove facing said at least one steam outlet and optionally, when the device comprises a comb, a covering for said comb, the second piece, one side of the first and of the second contact surfaces, and any other element of the device partially creating a confinement around said at least one steam outlet.

The presence of this confined area makes the presence of the sealing element all the more useful.

Confinement, at least partial, makes it possible to locally accumulate more steam in the volume between said at least one steam outlet and the confinement structure, which can lead to a reduction in the flow of steam necessary for treating the hair. The amount of steam needed for treatment can be reduced, therefore extending the autonomy of the device and decreasing the amount of residual moisture on the hair when it is removed from the device. In addition, the confined area can help improve the distribution of the steam longitudinally, between the steam outlets. The strand of hair can thus be treated more evenly in the transverse direction. Furthermore, the relative partitioning created by the confined area makes it possible to apply most of the steam only locally, during the passage of the strand of hair in the area situated at the level of said at least one steam outlet.

The device according to the invention can be autonomous, with an integrated water tank, or include a handpiece which is formed by the arms and a base station to which the handpiece is connected, which comprises a tank containing the water for steam production.

The cumulative steam flow rate for (all of) the steam outlet(s) is preferably between 0.5 and 1.1 g/min, being preferably less than or equal to 3.5 g/min, better still, less than or equal to 1 g/min, for example comprised between 0.7 g/min and 0.9 g/min.

Said at least one steam outlet advantageously comprises at least one steam ejection channel and at least one steam ejection nozzle. This channel can be oriented perpendicular to the longitudinal axis of the corresponding arm. The nozzle can have the same orientation; thus, the steam is emitted in a direction perpendicular to the contact surfaces, that is to say, in a direction perpendicular to the direction of travel of the strand of hair in the device. Preferably, the nozzle(s) is/are of conical shape with a circular section, the section of the nozzles widening in the direction of the outlet of the nozzles. Each steam ejection nozzle is preferably mounted at one end of each steam ejection channel. The nozzles can be identical to each other. The channels can be identical to each other.

The steam outlet(s) is/are preferably supplied with steam by a steaming chamber which is itself supplied with water by a pump. The steam is preferably water vapor, in particular without additives.

The device can comprise a system for heating the first contact surface consisting of a thermistor with a positive temperature coefficient, known as PTC, and a system for measuring the temperature of the heating device consisting of a thermistor with a negative temperature coefficient, known as NTC.

When the device includes a thermistor with a positive temperature coefficient and a thermistor with a negative coefficient, these can advantageously be arranged behind the first contact surface, and the device can include two plugs, in particular made of silicone, arranged at the longitudinal ends of the housing that receives them. This protects the PTC and NTC thermistors from any possible presence of condensate which could shorten leak lines and generate a risk for the user.

Each plug is advantageously perforated with two holes in order to allow the wires of the NTC thermistor to run in front of the first contact surface and the wires of the PTC thermistor to run behind the first contact surface.

When steam is emitted in a confined area, it cannot escape vertically or laterally perpendicular to the longitudinal axis of the device. Thus, the steam can escape longitudinally, from the front of the device or from the rear, from the side of a grip area of the device. The grip area is a cooler area. It is not desirable for the steam to escape towards the grip area, which is held by the user when operating the device, due to the associated risk of discomfort or even of burns. The device can thus include a seal positioned behind said at least one steam outlet, in particular behind the last nozzle, on the side of the grip area of the device. This seal is fixed, for example, on the second arm, and is designed to come into contact with the first arm in a position close to the arms. The seal is preferably arranged between the end of said at least one steam outlet and a pivot connection allowing the arms to form a clamp. It is intended to extend, in a direction perpendicular to the longitudinal axis of the device, behind the contact surfaces and behind said at least one steam outlet, so as to produce a rear partition forcing the steam to escape through the front of the device.

The aforementioned third piece may advantageously have an elongated wall in the direction of the grip area of the device, towards the rear of the latter. The third piece is at least in indirect contact with the first contact surface. Thus, as soon as the device is switched on, the third piece is heated and can, by its elongated wall in the direction of the grip area, accelerate the heating of the shell of the first arm, so as to limit the risk of condensation of steam on the internal and external surfaces of this shell.

The steaming chamber is advantageously supported by a supporting element in the second arm. The supporting element of the steaming chamber may have an elongated wall towards the grip area of the device. This provides heat to the inner and outer surfaces of the shell of the second arm in order to limit condensation on these surfaces.

BRIEF DESCRIPTION OF THE DRAWINGS

The invention will be better understood on reading the detailed description which follows, of non-limiting examples of implementation thereof, and on examining the drawings, in which:

FIG. 1 is a schematic side view of an example of a hair treatment device according to the invention.

FIG. 2 is a schematic view of the other side of the device in FIG. 1, the device having been turned over.

FIG. 3 is a schematic front view of the device in FIG. 1.

FIG. 4 is a schematic and partial side view of an example of the device according to the invention, the device being shown in a spread (or open) configuration.

FIG. 5 is a schematic view of a transverse cross-section along the A-A axis of the device in FIG. 2.

FIG. 6 is a schematic view of a transverse cross-section along the A-A axis of another example of a device according to the invention.

FIG. 7 is a schematic and partial view of a transverse cross-section along the A-A axis, and in perspective, of a detail of the device in FIG. 6.

FIG. 8 is a schematic and partial view of a transverse cross section along the C-C axis and in perspective, of a detail of the device in FIG. 6.

FIG. 9 is a schematic and partial view, in longitudinal cross-section and in perspective, of another detail of the device in FIG. 6.

FIG. 10 is a top view of a sealing element equipping the device in FIG. 1.

FIG. 11 is a transverse cross-section view, along the C-C axis and in perspective, of the sealing element in FIG. 10.

FIG. 12 is a perspective view of a sub-assembly of the device in FIG. 1 in which the sealing element in FIG. 10 is concealed.

DESCRIPTION OF THE EMBODIMENTS

In the following description, identical elements or identical functions bear the same reference sign. Their detailed description is not repeated in relation to each of the figures, and only the main differences between the embodiments are mentioned.

FIG. 1 shows a hair treatment device 1 in accordance with an exemplary embodiment according to the invention.

In the example illustrated, the device 1 is autonomous, with an integrated water tank 2. Only a portion of the power cord 3 is visible in FIGS. 1 and 2.

The device 1 comprises a first arm 4 and a second arm 5 extending along a longitudinal axis Y of the device 1, movable in relation to each other, which can be opened to introduce a strand of hair between them and closed to treat the strand of hair. FIGS. 1, 2, and 3 in particular illustrate this latter configuration. FIG. 4 illustrates, within a device 1, the open configuration of the first and second arms 4 and 5 for introducing a strand of hair between them.

The first and second arms 4 and 5 are hinged together by means of a pivot connection 6 so as to form a clamp. The casing of each of the first and second arms 4 and 5 comprises a shell, respectively referenced 17 and 18, which houses various constituent elements. The first and second arms 4 and 5 can be moved in the closed configuration along the strand of hair to be treated and comprise respective proximal portions 4*a* and 5*a* that can be concomitantly grasped with one hand to manipulate the device 1. Thus, during the hair styling operation, and in particular during the straightening operation, the user will manually apply pressure to each of the proximal portions 4*a* and 5*a* so as to close the first and second arms 4 and 5.

The first and second arms 4 and 5 also comprise respective distal portions 4*b* and 5*b*, equipped with corresponding first and second plates 10 and 11 arranged facing each other, which allows the hair to be clamped between them. During the hair styling operation, and particularly the hair straightening operation, a certain force is necessarily exerted when clamping the hair. This clamping force is thus directly related to the pressure exerted by the user on the proximal portions 4*a* and 5*a* to close the first and second arms 4 and 5.

The first and second plates 10 and 11 define the first and second respective contact surfaces 12 and 13, which heat up. "Contact" means contact with the strand of hair or any other capillary fiber as mentioned above.

In the example shown, the first and second contact surfaces 12 and 13 are substantially flat.

The first plate 10 is heated by at least one resistive heating element 15, in this case a PTC (positive temperature coefficient) thermistor, housed in a housing 22 of the first arm 4, not far from the first contact surface 12. As a variant, the first and second plates 10 and 11 are each heated by a separate heating device, in which case another resistive heating element is mounted in the housing 23, for example.

It should be noted that variant shapes are possible for the first and second contact surfaces 12 and 13. For example, curved surfaces can be used, such as the ones used with certain hair treatment devices for curling or waving the hair, such as those used in hair crimpers, or even equipped with a plurality of protuberances, such as teeth, for example. Preferably, the contact surfaces 12 and 13 are then complementary so as to clamp the strand of hair firmly.

The device 1 also comprises at least one steam outlet 20, in this case several outlets, supported by the second arm 5, in this example at a distance from the second plate 11, in order to steam the hair placed between the first and second arm 4 and 5 when it is within this steam application zone. More specifically, in this example the hair is thus exposed first to steam through the remote steam outlet 20 and then to the mechanical pressure of the contact surfaces 12 and 13.

The device 1 comprises at least one comb 30 comprising at least one row of teeth 31, the comb 30 in this example being supported by the second arm 5. The comb 30 can comprise rigid teeth and/or flexible bristles such as, for example, tufts of silk bristles or a combination of rigid teeth and flexible bristles.

In this example, the first arm 4 comprises at least a first piece 40 supporting the first plate 10 and at least one second piece 41 distinct from the first and separated from the latter.

The device 1 further comprises, according to the invention, an elastically deformable sealing element 50 which extends at least partially around the first plate 10 (or first contact surface 12) between the latter and the first supporting piece 40. More specifically, as can be seen in FIG. 10, for example, the sealing element has a central window 500, or main opening, which enables the sealing element 50 to be arranged around the first plate 10. Preferentially, the sealing element 50 runs completely around the first plate 10 as can be seen in the other figures so as to prevent any external element (steam, water, cosmetics, solid body, etc.) from penetrating the interior of the first arm 4.

The sealing element comprises a plurality of openings 59 as can be seen in FIGS. 10 and 11 in particular. These openings 59 are evenly distributed around the central window 500. Said first supporting piece 40 and said first contact surface 12 are then in contact with each other through said plurality of openings 59, which allows the full clamping force to be properly transmitted to the hair. As can be seen, the sealing element 50 has 20 openings 59 symmetrically distributed and facing each other in pairs with respect to the first plate 10. Each opening 59 is rectangular in shape and has, for example, a length of about 6 mm and a width of about 1 mm.

However, other embodiments for these openings 59 could be foreseen without departing from the scope of the invention. For example, a continuous groove could be foreseen such that the plurality of openings 59 would then be grouped within a single large longitudinal groove. The sealing element 50 could thus comprise a single opening 59, or optionally two openings 59 arranged facing each other.

The path of the mechanical effort is explained more precisely below. It should be noted that, for the sake of brevity, only the path of the force in the first arm 4 is described; it can be easily deduced that the force in the second arm 5 follows a similar path.

The force is generated by the user's hand and is transmitted to the proximal portion 4*a* of the first arm 4. The latter then transmits it to the distal portion 4*b*. This latter transmits the force to the first supporting piece 40, for example through a third piece 42 as can be seen in FIGS. 5 and 6. The first piece 40 can then directly transmit the force to the first plate 10 through the sealing element, due to said plurality of openings 59, as can be seen in FIG. 8 and FIG. 10. Such a construction ensures full transmission of the mechanical force, contrary to the constructions known in the prior art which could result in loss of force due to the elasticity of the sealing element 50.

More specifically, said first piece 40 comprises, on at least piece of its periphery, a plurality of slots 401 as can be seen in FIGS. 8 and 12. "Slots" means a succession of protrusions projecting from the first piece 40 so as to form an uneven, cut-out, non-linear contour as can be seen in FIG. 12, similar to the slots at the ends of fortress walls. The slots are complementary in shape to the openings 59. In this case, the slots 401 are substantially rectangular in shape with a height (projected distance relative to the first piece 40) of about 1 mm, over a length of about 6 mm and a width of about 1 mm. These dimensions have been specially designed to optimize the transmission of the force while retaining a minimal volume.

These slots 401 are thus in contact with the first contact surface 12 through the plurality of openings 59 as shown in FIG. 8. In other words, it is through these slots 401 that the clamping force is transmitted from the first piece 40 to the first plate 10 (first contact surface 12), and thus to the strand of hair. The first plate has the same number of slots 401 as the number of openings 59, namely 20 in the illustrated example. This number was determined to provide a suitable distribution of the forces over the entire surface of the first plate 10 while conserving acceptable manufacturing costs.

In the aforementioned case where the sealing element 50 comprises a single opening, it will be readily understood that the first piece 40 then comprises only one slot 401.

As can be seen in FIG. 8, said plurality of slots 401 is in contact with the first plate 10 (or first contact surface 12) over at least a piece of the periphery of the first plate 10. Said first plate 10 is substantially rectangular in shape with two sides forming the length of the rectangle and two sides forming the width of the rectangle, said plurality of slots 401 being in contact with the first plate 10 solely on the two sides forming the length of said rectangle, as can be seen in FIG. 12. This ensures both the efficient transmission of the mechanical force as explained above, while facilitating the assembly of the device and minimizing the costs of various pieces.

As can be seen in FIG. 7 or 8, the first piece 40 further comprises a support ridge 402, or more specifically two support ridges 402, in contact with the first plate (or first contact surface 12). These support ridges 402 extend along the entire length of the first plate, in directions parallel to the Y axis. Such a construction makes it possible to relieve the slots 401 of a portion of the mechanical force by having this force also pass through the support ridges 402.

However, an alternative construction, not illustrated in the figures but in which there would be no support ridge or ridges 402, could also be envisaged without departing from the scope of the invention. In this alternative construction not shown, the plurality of slots 401 would then be the only contact with the first plate 10 (or first contact surface 12).

More specifically, the sealing element 50 comprises a proximal portion 51 extending at least partially around the first plate 10 between the latter and the first supporting piece 40, and a distal portion 52 extending in contact with the second piece 41, the proximal portion 51 and distal portion 52 being connected by an intermediate portion 53 extending between the first piece 40 and the second piece 41.

The width w1 of the intermediate portion 53, measured in a plane transverse to the longitudinal axis Y of the device 1, can be greater than 1 mm, being in particular less than 4 mm.

The overall length of the intermediate portion 53 measured in a transverse plane can be greater than 5 mm, in particular greater than 7 mm.

The intermediate portion 53 connects the proximal 51 and distal 52 portions such that there can be a drop Δh between a low point P of the proximal portion 51 and a low point Q of the distal portion 52, for example as can be seen in FIG. 5, preferably greater than 2 mm, etc., being for example less than 6 mm, being for example substantially equal to 3.6 mm.

The total height of the sealing element 50, which corresponds to the distance measured between point P and the top of the concave piece of the intermediate portion 53, is preferably comprised between 5 and 15 mm, given that this height varies according to the transverse cross section of the sealing element 50. In particular, this height is minimal in the middle of the length while it is maximal in the angles. Advantageously, the minimum height is substantially equal to 8 mm and the maximum height is substantially equal to 10 mm.

The proximal portion 51 extends over the entire periphery of the first plate 10.

The plurality of openings 59 is made in the proximal portion 51 as can be seen in FIG. 10. The sealing element 50 is substantially rectangular in shape with two sides forming the length of the rectangle and two sides forming the width of the rectangle, said plurality of openings 59 being arranged solely on the two sides forming the length of said rectangle.

As can be seen in FIG. 5, the proximal portion 51 of the sealing element 50 is clamped between the first plate 10 and a ridge 55 of the first piece 40. In this example, the proximal portion 51 has a generally H-shaped cross section. The proximal portion 51 has a groove 56 inserted in a return 57 of the first plate 10 and an opposite groove 58 inserted in the ridge 55 of the first piece 40.

Said plurality of openings 59 is then made between said grooves 56, 58 so that said grooves 56, 58 communicate with each other, as shown in FIG. 11. This particular construction notably makes it possible to guarantee an excellent sealing, since the H shape of the proximal portion ensures the sealing between the first piece 40 and the first plate 10 in spite of the presence of openings 59 between the grooves 56 and 58.

The distal portion 52 is clamped between the second piece 41 and a third internal piece 42 of the first arm 4, formed in this example by an internal piece of the shell 17.

The intermediate portion 53 has at least one cross-sectional bend. In the example shown, the intermediate portion 53 is curved concave towards the opposite arm 5, with a U-shaped bottom in the transverse cross section.

The first plate 10 has a generally rectangular shape with four sides. The intermediate portion 53 and the distal portion 52 extend around three of the four sides of the first plate 10 only. The intermediate portion 53 and the distal portion 52 are absent from the side 16 of the first plate 10 that is furthest from said at least one steam outlet 20. Thus, FIG. 5 shows the sealing element 50 on the side of the first plate 10 that is opposite the steam outlet 20 which only comprises the proximal portion 51. The other three sides of the first plate 10 are surrounded by the assembly of the proximal portion 51, the distal portion 52 and the intermediate portion 53 of the sealing element 50. This makes it possible to reduce the width of the device 1 without substantially affecting the seal.

Due in particular to this characteristic, the sealing element 50 has an asymmetrical shape, as can be seen in FIG. 10, relative to a median plane running through the first plate 10 parallel to the longitudinal axis Y of the device 1 and perpendicular to a first contact surface 12 of the first plate 10 facing the second plate 11.

Again in this example, the sealing element 50 is present on a single arm, namely the first arm 4, said at least one steam outlet 20 being supported by the other arm, namely the second arm 5. Preferentially, the sealing element 50 and in particular the intermediate portion 53 is located in the steam ejection zone, optionally slightly offset from said at least one steam outlet 20 so as to form a barrier to the steam. "Slightly offset" means an offset comprised between 2 and 15 mm and advantageously substantially equal to 7 mm relative to the steam ejection axis. Preferably, the offset is towards the inside of the device.

In this example, the device 1 does not have a reservoir for a cosmetic composition, nor an applicator for a cosmetic composition.

The second piece 41 faces said at least one steam outlet 20.

In the example shown in FIG. 5, the device 1 comprises a confined area 90 around said at least one steam outlet 20. The confined area 90 is delimited in this example by a confinement structure 21 formed by the second piece 41 which allows for at least partial confinement of the steam emitted by the device. This confinement structure 21 comprises in this example a groove 25 facing the steam outlets 20. The confined area 90 is also delimited by the comb 30. The confinement structure 21 also includes a cover 91 for said comb 30.

The first plate 10 is, in the example illustrated in FIG. 5 or 6, pivotally mounted on the corresponding first arm 4 via the insertion of a head 110 in the form of a portion of a sphere, formed in the first piece 40, in a housing defined by a cylindrical wall 111 formed with the shell 17 of the first arm 4.

The support of the spherical surface of the head 110 on the circular edge of the wall 111 creates a ball joint, which allows the first plate 10 to pivot when the thickness of the strand of hair that is clamped between the plates is not uniform or is not placed in the center of the first plate 10, and thus to have a larger contact surface with the strand. FIG. 5 shows a helical spring 62 which is supported at one end against the bottom of the housing defined by the cylindrical wall 111 and at the other end against the head 110. The deformability of the sealing element 50 due to the intermediate portion 53 allows it to accompany this pivoting of the first plate 10 while acting as a barrier to the steam. Indeed, the bellows shape of said intermediate portion 53 gives the sealing element remarkable flexibility, while its proximal 51 and distal 53 portions are fixed, respectively with the first plate 10 and the second piece 41.

The lower piece of the second arm 5 houses the steaming chamber which enables the creation of steam which is then projected through the outlets 20 through the channels and nozzles.

Such a steaming chamber can comprise a system for heating the first contact surface consisting of a thermistor with a positive temperature coefficient, known as PTC, and a system for measuring the temperature of the heating device consisting of a thermistor with a negative temperature coefficient, known as NTC.

The total steam flow delivered by all the steam outlets can be comprised between 0.5 g/min and 0.8 g/min or between 2 and 2.5 g/min.

The steaming chamber is itself supplied by means of an electric pump and in particular a peristaltic pump, itself connected to the reservoir 2, these elements preferentially being located in the second arm 5.

The device 1 can also include an electronic card, not shown, configured to manage the power supply of the resistive heating elements in order to control the operating temperature. This electronic card can be arranged inside one of the two arms 4 or 5, for example in the proximal portion 5*a* of the arm 5, and have a user interface.

The device 1 may further comprise a magnetic sensor, not shown, such as an ILS flexible blade switch, which makes it possible to detect the closed position of the arms 4 and 5, in which the surfaces 12 and 13 are substantially one against the other to clamp the strand of hair to be treated. In another variant, the flexible blade switch could be replaced by a magneto-resistive sensor (MRS), or by any other detection means.

In the embodiment illustrated in FIG. 6, the second piece 41 is different. In this example, as can be seen in particular in FIG. 6, the second piece 41 has a groove 60 in which the distal portion 52 is received at least partially, the third piece 42 having a ridge 61 pressing on the distal portion 52 vertically to said groove 60.

As can be seen in particular in FIGS. 7 and 8, the intermediate portion 53 has a height h that varies along at least one side of the first plate 10, and along each side of the first plate 10 in which the intermediate portion 53 is present. The height h of the intermediate portion 53 is minimal, substantially at mid-length of at least one side of the first plate 10, and increases towards the ends of said side.

The difference in height h of the intermediate portion 53, maximal at the corners of the sides of the first plate 10 and minimal at the centers of the sides of the first plate 10, is in particular chosen so as to allow for the pivoting of the first plate 10. Indeed, the further the distance from the head 110, the greater the amplitude of the movements of the first plate 10 when it pivots at a given angle. These high-amplitude movements are thus notably facilitated by the maximum difference in height h at the corners, since the length of the bellows is then maximized.

In the example shown in FIG. 6, the water tank is not integrated into the device 1, but in a separate station.

As illustrated in FIG. 6, the device 1 can include a cartridge 80 containing a cosmetic composition C to be applied to the hair, the second piece 41 serving as a support for said cartridge 80. The second piece 41 can then have a slide 81 into which the cartridge 80 is inserted. The cartridge 80 comprises a porous material 82 impregnated with said composition C. In the example illustrated, the porous material 82 is a felt. The second piece 41 comprises a ridge 85 pressing against said porous material 82, on the side opposite the sealing element 50. In this example, the ridge 85 partially penetrates into the porous material 82, as can be seen.

The cartridge 80 is also held in place in this example by being inserted into a slide 86 of the device 1.

In this example, the confined area 90 is delimited by the cartridge 80, the comb 30, and one side of the first and second plates 10 and 11.

The device 1 comprises a system for heating the first plate 10 consisting of a thermistor with a positive temperature coefficient PTC 15, and a system for measuring the temperature of the heating device consisting of a thermistor with a negative temperature coefficient NTC 101. The thermistors PTC 15 and NTC 101 are, as can be seen in FIG. 9, arranged behind the first plate 10. The device 1 comprises two plugs 102, for example made of silicone, arranged at their longitudinal ends. This protects the thermistors 15 and 101 from any possible presence of condensate which could shorten the lines of leakage and generate a risk for the user.

Each plug 102 is advantageously perforated with two holes, not shown in the figure for the sake of clarity of the drawing, in order to allow the wires of the thermistor 101 to be run in the front of the first plate 10 and the wires of the thermistor 15 to the back of the first plate 10.

The invention claimed is:

1. A hair treatment device, comprising:

a first and a second arm, movable in relation to each other, configured to be opened to introduce a strand of hair therebetween and to be closed to treat the strand of hair, a first and second contact surfaces respectively supported by the first and second arms, arranged facing each other, with at least one of said contact surfaces configured to be heated, at least the first arm comprising at least one first piece supporting the first contact surface, a sealing element comprising a central window arranged such that the sealing element extends at least partially around the first contact surface between the first contact surface and the first supporting piece, said sealing element comprising at least one opening that is distinct from the central window and said first supporting piece and said first contact surface coming into contact with each other through said at least one opening, wherein the device comprises at least one steam outlet supported by one of the first and second arms, the at least one steam outlet outside of and spaced from a perimeter of the contact surface on the same arm, so as to expose the hair held between the arms to the steam, wherein the sealing element comprises a plurality of openings, and wherein said first supporting piece comprises a plurality of slots in contact with the first contact surface through said plurality of openings on at least piece of the periphery of the contact surface.

2. The device according to claim 1, wherein said plurality of openings is evenly spaced around the central window.

3. The device according to claim 1, further comprising at least one second piece that is distinct from the first supporting piece and separate from the first supporting piece, the sealing element comprising a proximal portion extending at least partially around the first contact surface between the first contact surface and the first supporting piece and a distal portion extending in contact with the at least one second piece, the proximal portion and distal portion connected by an intermediate portion extending between the first supporting piece and the at least one second piece and configured to form a barrier to the steam.

4. The device, according to claim 3, wherein said intermediate portion has at least one cross-sectional bend.

5. The device according to claim 3, wherein said at least one opening is made in the proximal portion.

6. The device according to claim 1, wherein said sealing element is clamped between the first contact surface and a ridge of the first supporting piece, having a cross section that is generally H-shaped, with a groove inserted into a return of the first contact surface and an opposite groove inserted into said ridge of the first piece.

7. The device according to claim 6, wherein said at least one opening is made between the groove and the opposite groove so that said groove and the opposite groove communicate with each other.

8. The device according to claim 1, wherein said sealing element is substantially rectangular in shape with two sides forming a length of the rectangle and two sides forming a width of the rectangle, said plurality of openings arranged solely on the two sides forming the length of said rectangle.

9. The device according to claim 1, wherein said first supporting piece comprises, on at least piece of a periphery thereof, at least one slot in contact with the first contact surface through said at least one opening.

10. The device according to claim 9, wherein the first supporting piece also comprises a support ridge in contact with the first contact surface.

11. The device according to claim 1, wherein said first contact surface is substantially rectangular in shape with two sides forming a length of the rectangle and two sides forming a width of the rectangle, said plurality of slots in contact with the first contact surface solely on the two sides forming the length of said rectangle.

12. The device according to claim 1, wherein said at least one slot or said plurality of slots is the only contact with the first contact surface.

13. The device according to claim 1, wherein the perimeter of the contact surface on the arm which supports the at least one steam outlet is defined by outer edges of a total surface configured to contact the other contact surface when the hair treatment device is closed.

* * * * *